United States Patent [19]

Iwakura et al.

[11] Patent Number: 4,730,474

[45] Date of Patent: Mar. 15, 1988

[54] METHOD OF RELIEVING RESIDUAL STRESS IN METAL PIPE

[75] Inventors: Shota Iwakura; Yuuji Yoshitomi; Takashi Naganawa, all of Ibaraki; Toshio Saitoh; Tatsuo Seki, both of Hitachi, all of Japan

[73] Assignee: Hitachi, Ltd., Tokyo, Japan

[21] Appl. No.: 846,144

[22] Filed: Mar. 31, 1986

[30] Foreign Application Priority Data

Apr. 1, 1985 [JP] Japan ..... 60-66442

[51] Int. Cl.[4] ..... B21D 26/00

[52] U.S. Cl. ..... 72/61; 72/62; 72/54; 29/421 R

[58] Field of Search ..... 72/58, 54, 61, 62; 29/421 R

[56] References Cited

U.S. PATENT DOCUMENTS

| | | | |
|---|---|---|---|
| 2,168,641 | 8/1939 | Arbogast | 72/58 |
| 2,203,868 | 6/1940 | Gray et al. | 72/58 |
| 3,216,092 | 11/1965 | Arbogast | 72/58 |
| 3,611,768 | 10/1971 | Odagaki | 72/58 |
| 3,974,675 | 8/1976 | Tominaga | 72/58 |
| 3,986,654 | 10/1976 | Hart et al. | 228/155 |
| 4,590,655 | 5/1986 | Javorik | 72/58 |

FOREIGN PATENT DOCUMENTS

| | | | |
|---|---|---|---|
| 144334 | 11/1980 | Japan | 72/62 |
| 191524 | 10/1984 | Japan | 72/58 |

*Primary Examiner*—Robert L. Spruill
*Assistant Examiner*—David B. Jones
*Attorney, Agent, or Firm*—Antonelli, Terry and Wands

[57] ABSTRACT

A method of relieving residual stress in a metal pipe comprises the steps of applying, by using a pressure medium, a low pressure to an interior of the metal pipe placed in dies, and applying, while preventing the buckling, an axial compression load to the pipe so as to effect a uniform plastic deformation of the entire metal pipe while maintaining the desired shape of the pipe, thereby relieving the residual stress in the metal pipe.

2 Claims, 9 Drawing Figures

METHOD OF RELIEVING RESIDUAL STRESS IN METAL PIPE

BACKGROUND OF THE INVENTION

The present invention relates to a method of relieving residual stress in a metal pipe.

U.S. Pat. No. 3,986,634 discloses a method of relieving residual stress in a metal pipe, in which the metal pipe is thermally treated together with a mandrel which has a thermal expansion coefficient greater than the pipe. This treatment is generally referred to as "thermal sizing treatment". This method, however, cannot be applied satisfactorily to a long pipe because there is a risk that the inner surface of the pipe may be damaged by the mandrel during insertion of the same, as a result of deformation of the pipe incurred during press work, welding or other work conducted prior to the thermal sizing treatment. Additionally, a long time period is required for the insertion and withdrawal of the mandrel, as well as for the removal of the scratching or other defects in the inner surface of the pipe due to the insertion of the mandrel.

SUMMARY OF THE INVENTION

Accordingly, an object of the invention is to provide a method of relieving residual stress in a metal pipe which minimizes if not avoids damaging the inner and outer surfaces of the pipe regardless of the length of the pipe.

Another object of the invention is to provide a method of relieving stress in a metal pipe which is conducted in cold state so that it is possible to omit a heat treatment.

To this end, according to advantageous features of the invention, a method of relieving residual stress in a formed metal pipe is proposed which comprises placing the formed pipe in dies; introducing a pressure medium which is a liquid or an elastic material into the pipe to establish a low pressure sufficient to prevent buckling of the pipe which otherwise may occur when the pipe is axially compressed; and applying an axial compression load to the pipe so as to effect a uniform plastic deformation of the pipe while maintaining the desired shape of the pipe, thereby relieving the residual stress.

In accordance with further advantageous features of the invention, a method of relieving residual stress in a formed metal pipe is proposed which comprises placing the formed pipe in dies; introducing a presure medium which is a liquid or an elastic material into the pipe so as to effect a bulging on the pipe and thereafter establishing in the pipe a low pressure sufficient to prevent buckling of the pipe which otherwise may occur when the pipe is axially compressed; and applying an axial compression load to the pipe so as to effect a uniform plastic deformation of the pipe while maintaining the desired shape of the pipe, thereby relieving the residual stress.

DETAILED DESCRIPTION

An embodiment of the stress relieving method of the invention will be described hereinunder with reference to FIGS. 1 to 9. Although a pipe having a square cross-section is mentioned in the following description, the method of the invention can also be applied to pipes having other cross-sectional shapes.

Figure 1:
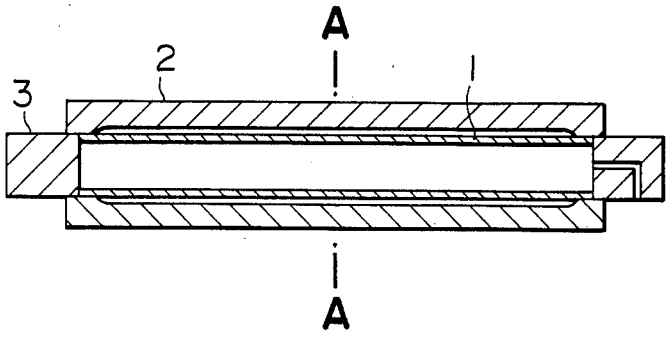
FIG. 1 is a longitudinal sectional view of an apparatus which is used in carrying out the stress relieving method of the invention.
Figure 2:
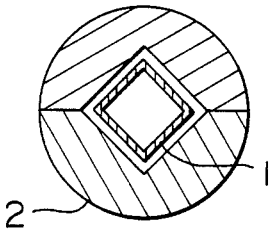
FIG. 2 is a cross-sectional view taken along the line A—A in FIG. 1.
Figure 3:
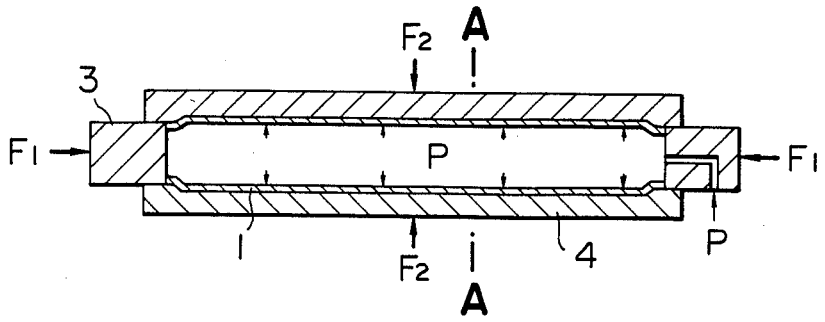
FIG. 3 is a longitudinal sectional view of a metal pipe after a bulging conducted as a step of the method of the invention.
Figure 4:
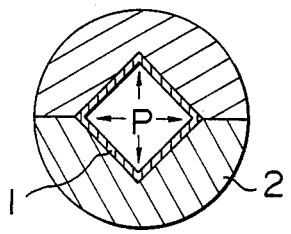
FIG. 4 is a cross-sectional view taken along the line A—A in FIG. 3.

Referring now to the drawings wherein like reference numerals are used throughout the various views to designate like parts and, more particularly, to FIG. 1, according to this Figure a pipe 1, in the state before bulging is formed as a blank and is placed in sectional dies 2 which are then closed and tightened by a die-closing press (not shown) so as to be positioned as shown in FIG. 2. Under this state, a pressurizing rod 3 is driven into the dies 2 so as to apply a load $F_1$ in the axial direction of the pipe 1, and a pressure P is sealed in the pipe 1. By applying the axial compression load $F_1$ and the internal pressure P to the pipe 1, it is possible to expand the pipe 1 into close contact with the dies 2, thus effecting a bulging of the pipe 1 within the dies 2. FIGS. 3 and 4 illustrate the state of the pipe 1 after the bulging. The bulging is effected with a high dimensional precision because the pipe 1 is held in close contact with the dies 2.

The pipe 1 in this state, however, has a residual stress which was caused before the bulging (i.e., during press forming, welding, and the like) or during the bulging.

Figure 5:
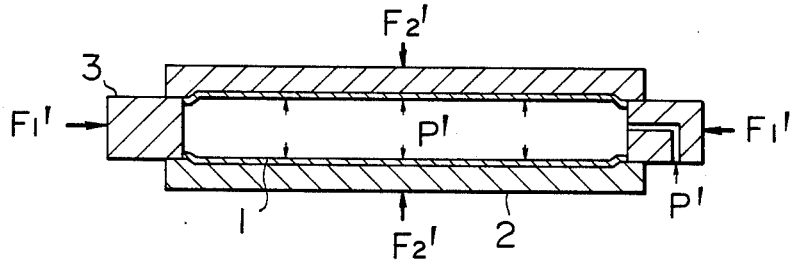
FIG. 5 is a longitudinal sectional view of an apparatus and a metal pipe, illustrating the principle of the stress relieving method of the invention.
Figure 6:
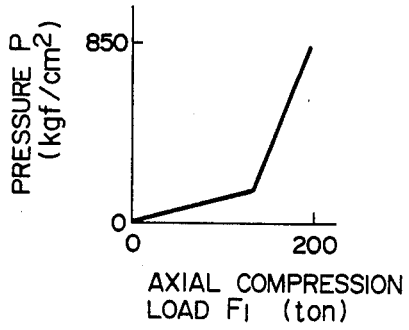
FIG. 6 is a graphical illustration of the conditions of bulging.

After the bulging, as shown in FIG. 5 an axial compression load $F_1'$ is applied to the expanded pipe 1 so as to cause a plastic deformation of the pipe 1, while maintaining a pressure P' which is lower than the pressure P applied during the bulging. In this time, the pipe is uniformly plastically deformed, so that the residual stress caused before or during the bulging can be redistributed and decreased. It will also be understood that there is no risk of buckling of the pipe 1 because the pipe 1 is restrained by the pressure P' and the dies 2. Additionally, the desired shape of the pipe 1 is maintained because the pipe 1 is deformed within the dies 2. The low pressure P' applied to the interior of the pipe 1 is a pressure which can prevent the buckling by compressing the surface of the pipe 1 by the dies 2 thereby restraining a deformation in the direction perpendicular to the wall of the pipe 1. However, a high pressure P' correspondingly increases the friction force between the dies 2 and the surface of the pipe 1, so that the axial compression load $F_1'$ applied to the axial ends of the pipe 1 is not uniformly transmitted to the mid portion of the pipe 1. As a result, the pipe 1 is not plastically uniformly deformed over its entire length. Further, in the plastic deformation, even when a part of the axial compression load is transmitted to the mid portion of the pipe 1, the thickness of the pipe 1 is varied beyond an allowable tolerance, in such a manner that the thickness is greater at both axial ends than at the mid portion of the pipe 1. For these reasons, the pressure P' applied to the pipe 1 should be a low pressure of such a degree that can prevent the occurrence of buckling.

Figure 7:
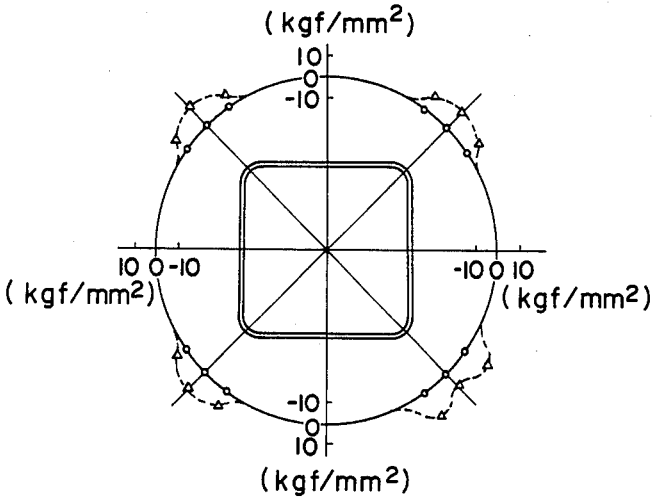
FIG. 7 is a diagram showing the residual stress distribution in the metal pipe after the bulging.

In a practical example, the stress relieving method of the invention was applied to a pipe made from a zirconium alloy. The pipe had a square cross-section with a side length of 140 mm, a length of 500 mm and a thickness of 2 mm. The pipe 1, as a blank, was placed in the dies 2 and was restrained by pressurizing rods 3, as shown in FIGS. 1 and 2. Then, the pipe was bulged under the conditions shown in FIG. 6 so as to be expanded radially by an amount corresponding to deformation of several percents in terms of circumferential strain. After the bulging, axial tensile residual stress of 10 to 15 kgf/mm$^2$ remains on the outer surface of the square pipe 1 around each corner thereof, as shown in FIG. 7. In this case, at the initial stage of the bulging the pipe 1 is bulged by synchronizing the axial compression load and the pressure (internal pressure) applied to the interior of the pipe while preventing the buckling and rupture of the pipe 1, and thereafter by increasing only the internal pressure. However, the bulging condition varies depending on various factors such as the shape of the bulging and the quality, shape and size of the blank material, and is not limited to the bulging condition shown in FIG. 6.

Figure 8:
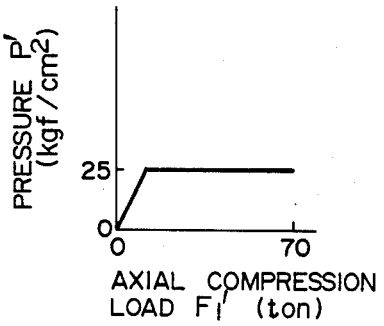
FIG. 8 is a graphical illustration of the condition under which the stress relieving operation is conducted.

In order to relieve the residual stress in the square pipe bulged in this way into a desired shape, the residual stress is relieved in the aforesaid dies as shown in FIG. 5 under the working condition shown in FIG. 8. Namely, a low pressure (25 kgf/mm$^2$) sufficient to prevent the buckling and can suppress the scattering of thickness within an allowable tolerance and an axial (longitudinal) compression stress (60 kgf/mm$^2$) greater than the yield stress are applied to the pipe 1, and thus the pipe 1 is shrunk by a predetermined amount. Thus, since the plastic state of the pipe is uniform at any cross-section, the pipe 1 is uniformly plastically deformed. In this case, the axial compression load is progressively increased under a condition wherein a constant low pressure (25 kgf/cm$^2$) is applied to the interior of the pipe. However, the stress relieving condition varies depending on various factors such as the quality, shape and size of the blank material of pipe, and so is not limited to the stress relieving condition shown in FIG. 8.

Figure 9:
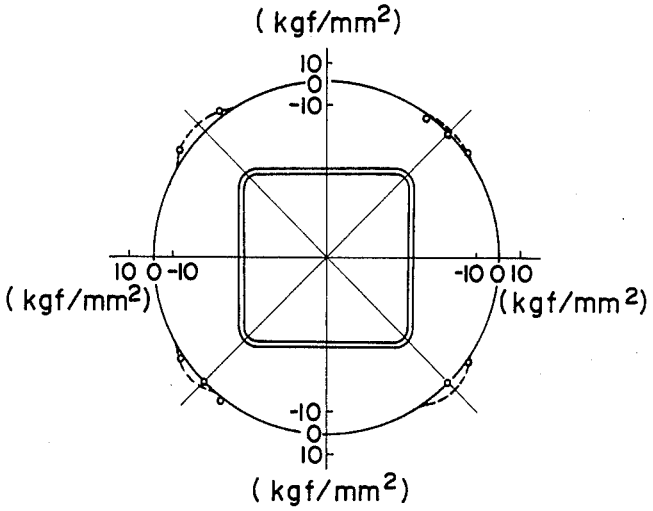
FIG. 9 is a diagram showing the residual stress distribution in the metal pipe after the stress relieving.

Consequently, the residual stress is redistributed and decreased. An example thereof is shown in FIG. 9 in which the residual stress is decreased to 0–4 kgf/mm$^2$.

Further, during the stress relieving operation, no buckling takes place and the desired shape of the pipe 1 is maintained because the pipe 1 is restrained by the pressure P' and the dies 2. For obtaining the product pipe of the desired length, it is preferred that the length of the blank pipe 1 is determined taking account of the yield and the amount of contraction which is expected to occur during the bulging. And, finally the pipe is cut into a predetermined length.

On the other hand, also with respect to a pipe formed by a method other than bulging, it is possible to decrease the residual stress in the pipe 1 by applying to the pipe 1 within the dies 2 of desired shape a low pressure for preventing the buckling of the pipe 1 and an axial compression load to thereby cause a uniform plastic deformation over the entirety of the pipe 1 while maintaining the desired shape of the pipe.

What is claimed is:

1. A method of relieving residual stress in a worked metal pipe, the method comprising: the steps of placing said worked metal pipe in dies having an inner surface shaped identical with an outer surface shape of said worked metal plate; introducing a liquid into said pipe thereby applying in said pipe a liquid pressure lower than a yield pressure of the metal pipe for preventing said metal pipe from buckling; and simultaneously applying to said pipe an axial compression load greater than a yield pressure for a material of said metal pipe so as to effect a uniform plastic deformation of said metal pipe in its entirety while maintaining the cross-sectional shape of said metal pipe before being subjected to said internal liquid pressure and said axial compression load, thereby relieving the residual stress in said pipe while suppressing an increase in a wall thickness thereof.

2. A method of relieving residual stress in a bulged metal pipe having been bulged by placing the metal pipe in dies and applying to said metal pipe an internal pressure and an axial load both of which are greater than a yield pressure of a material of said metal pipe, the method comprising the steps of: placing in succession, said bulged metal pipe in said dies used for said bulging; introducing a liquid into said metal pipe thereby applying in said metal pipe a liquid pressure lower than the yield of the material of the metal pipe for preventing said metal pipe from buckling; and simultaneously applying to said metal pipe an axial compression load greater than a yield pressure of the material of said metal pipe so as to effect a uniform plastic deformation of said metal pipe in its entirety while maintaining the cross-sectional shape of said metal pipe before being subjected to said internal liquid pressure and said axial compression load, thereby relieving the residual stress in said pipe while suppressing an increase in wall thickness.

* * * * *